US006810804B2

(12) United States Patent
Junghans et al.

(10) Patent No.: US 6,810,804 B2
(45) Date of Patent: Nov. 2, 2004

(54) INKING UNIT HAVING DISTRIBUTOR ROLLERS OSCILLATING AT DIFFERENT SPEEDS

(75) Inventors: Rudi Junghans, Wilhelmsfeld (DE); Bernhard Roskosch, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/054,599

(22) Filed: Jan. 22, 2002

(65) Prior Publication Data

US 2002/0096071 A1 Jul. 25, 2002

(30) Foreign Application Priority Data

Jan. 19, 2001 (DE) ..... 101 02 224
Sep. 19, 2001 (DE) ..... 101 46 071

(51) Int. Cl.[7] ..... B41F 31/00; B41F 31/15
(52) U.S. Cl. ..... 101/350.3; 101/352.06
(58) Field of Search ..... 492/15; 101/350.3, 101/352.06, DIG. 38, 348, 349.1, 350.1

(56) References Cited

U.S. PATENT DOCUMENTS 4,040,347 A 8/1977 Johne et al.
4,242,958 A 1/1981 Jeschke
4,397,236 A 8/1983 Greiner et al.
5,054,393 A * 10/1991 MacPhee ..... 101/348
5,823,109 A * 10/1998 Hummel et al. ..... 101/350.4

FOREIGN PATENT DOCUMENTS

| | | |
|---|---|---|
| DE | 26 21 429 | 2/1977 |
| DE | 26 48 098 C3 | 5/1978 |
| DE | 30 34 644 C2 | 4/1982 |
| DE | 298 12 966 U1 | 11/1998 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Gregory L. Mayback

(57) ABSTRACT

An inking unit for a printing machine, which is assigned to a printing form, includes a first distributor roller and a second distributor roller, the first distributor roller being in rolling contact simultaneously with two ink applicator rollers, and being axially oscillatable more slowly and disposed more closely to the printing form than is the second distributor roller; and a printing machine including the inking unit.

7 Claims, 1 Drawing Sheet

INKING UNIT HAVING DISTRIBUTOR ROLLERS OSCILLATING AT DIFFERENT SPEEDS

BACKGROUND OF THE INVENTION

Field of the Invention

The invention relates to an inking unit for a printing machine, which is assigned to a printing form and includes a first distributor roller and a second distributor roller.

An inking unit of this general type is described in the published German Patent Document DE 30 34 644 C2 and, in addition to the distributor rollers, also includes oscillating ink applicator or inking rollers. The frequency of the axial oscillation of one of the ink applicator rollers is slightly higher than the frequency of the axial oscillation of the distributor roller against which the one ink applicator roller bears. That ink applicator roller within a roller train, which is disposed closer to the printing form, therefore, oscillates faster than the distributor roller disposed farther away from the printing form.

An inking unit is likewise described in the published German Patent Document DE 298 12 966 U1 as including a first distributor roller and a second distributor roller. Furthermore, the inking unit includes a third distributor roller and a bridge-type roller, which is simultaneously in rolling contact with an ink applicator roller of the inking unit and a dampening-solution applicator roller of a dampening unit and oscillates at a distribution frequency of 1:8. The first distributor roller has a distribution frequency of 1:6 and oscillates more slowly than the second distributor roller and the third distributor roller, each of which oscillates at a distribution frequency of 1:4 and is disposed closer to a plate cylinder than the first distributor roller.

SUMMARY OF THE INVENTION

It is accordingly an object of the invention to provide an improved inking unit of the general type mentioned at the introduction hereto.

With the foregoing and other objects in view, there is provided, in accordance with one aspect of the invention, an inking unit for a printing machine, which is assigned to a printing form, comprising a first distributor roller and a second distributor roller, the first distributor roller being in rolling contact simultaneously with two ink applicator rollers, and being axially oscillatable more slowly and disposed more closely to the printing form than is the second distributor roller.

In accordance with another feature of the invention, the second distributor roller is axially oscillatable twice as quickly as the first distributor roller, so that a ratio between frequencies of oscillations of the two distributor rollers is 1:2.

In accordance with a further feature of the invention, a ratio between frequencies of the axial oscillations of the two distributor rollers is 1:3.

In accordance with an additional feature of the invention, the second distributor roller is disposed more closely to an ink duct than is the first distributor roller.

In accordance with a concomitant aspect of the invention, there is provided a printing machine having a printing form and an inking unit, comprising a first distributor roller and a second distributor roller, the first distributor roller being in rolling contact simultaneously with two ink applicator rollers, and being axially oscillatable more slowly and disposed more closely to the printing form than is the second distributor roller.

Thus, the object of the invention is achieved by an inking unit having a first distributor roller in rolling contact simultaneously with two ink applicator rollers, the first distributor roller being axially oscillatable more slowly and being disposed more closely to a printing form than is the second distributor roller.

The fact that, in the inking unit according to the invention, the first distributor roller is disposed closer to the printing form than is the second distributor roller, and a frequency of the axial oscillation of the first distributor roller is lower than a frequency of the axial oscillation of the second distributor roller, while the two distributor rollers oscillate simultaneously during printing operation, results in various advantages: the slow oscillation of the first distributor roller is advantageous with regard to reducing an ink gradient on the printing form. By an ink gradient, it is understood to mean a reduction in the ink layer thickness or ink density from the printing start to the printing end. The closer the first distributor roller is located to the printing form, i.e., the fewer the rollers of a roller train are located between the first distributor roller and the print form, the more effective the first distributor roller acts with regard to reducing the ink gradient. There is preferably only a single roller in the roller train between the first distributor roller and the printing form, specifically an ink applicator roller, against which the first distributor roller bears.

Rapid oscillation of the second distributor roller is advantageous with regard to eliminating ink-free strips, which are caused by supporting webs of metering elements of an ink metering system on an ink-duct roller belonging to the inking unit.

The mutually different frequencies of the axial oscillations of the two distributor rollers are additionally also advantageous with regard to the elimination of ghosting effects.

In an advantageous development of the inking unit according to the invention, the second distributor roller oscillates in the axial direction three times as quickly as the first distributor roller, so that the ratio between the frequencies of the oscillations of the two distributor rollers is 1:3. In other advantageous developments, the ratio between the frequencies of the axial oscillations of the two distributor rollers is 1:2 or 2:3.

In the event that the inking unit is equipped with an ink duct which, as an ink metering duct, is equipped with the ink metering system, the second distributor roller within the roller train can be disposed closer to this ink duct and therefore to the ink metering system than is the first distributor roller. The roller train, to which the first distributor roller and the second distributor roller can jointly belong, is a chain of rollers which roll on one another and, as a result, convey the printing ink from the ink metering system to the printing form.

Other features which are considered as characteristic for the invention are set forth in the appended claims.

Although the invention is illustrated and described herein as embodied in an inking unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing, wherein:

DESCRIPTION OF THE PREFERRED EMBODIMENTS

Figure 1:
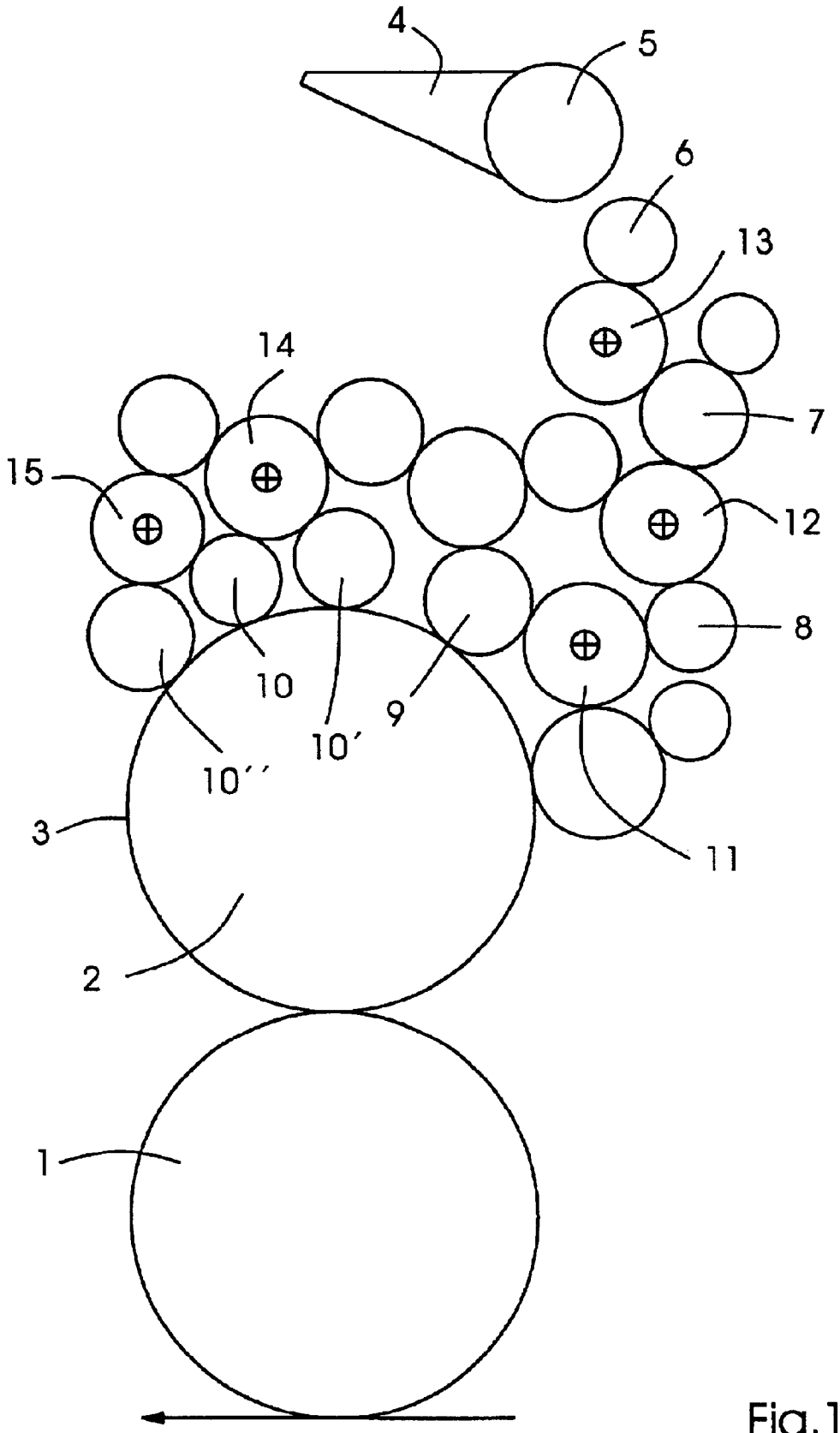
FIG. 1 is a diagrammatic side elevational view of a printing unit of a printing machine, which includes an inking unit according to the invention.

Referring now to the drawing, there is shown in the only figure thereof, namely FIG. 1, a printing unit of a printing machine having a blanket cylinder 1 and a printing-form cylinder 2, whereon a printing form 3 for offset printing is disposed. In order to the ink the printing form 3, the latter has an inking unit assigned thereto, which includes an ink duct 4, an ink duct roller 5, a vibrator or ductor roller 6, transfer rollers 7 and 8, applicator rollers, i.e., ink applicator or inking rollers 9, 10, 10' and 10", a first distributor roller 11, a second distributor roller 12, a third distributor roller 13, a fourth distributor roller 14 and a fifth distributor roller 15. The ink duct 4 is equipped with an ink metering system for zonal ink metering that is different over the printing width. The ink metering system is composed of a row of at least approximately cylindrical metering eccentrics, which function as metering elements. Each of the metering eccentrics controls the ink volume in another inking zone and has two annular supporting webs, between which a recess with a sickle-like profile is located. Depending upon the rotational position of the metering eccentric, which is set in accordance with the requirement of a zonal ink profile, a greater or lesser quantity of printing ink passes out of the ink duct 4 through the recess. The supporting webs bear on the ink duct roller 5 via a resilient film that clads the ink duct 4. An ink metering system of this type is described in detail in U.S. Pat. No. 4,242,598 and the published German Patent Document DE 26 48 098 C3 (note especially FIG. 11 in this document), respectively, the contents of the U.S. patent and the last-mentioned patent document being incorporated herein by this reference.

The distributor rollers 11 to 15 are rotatively driven formlockingly via a gear mechanism. In this regard, it is noted that a formlocking connection is one that connects two elements together due to the shape of the elements themselves, as opposed to a forcelocking connection, which locks the elements together by force external to the elements. Each of the distributor rollers 11 to 15 is firmly connected to another gear belonging to the gear mechanism, so as to be is fixed against rotation relative to the other gear, and is arranged coaxially with the respective distributor roller. The gears arranged coaxially with the distributor rollers 11 to 15 mesh with other gears belonging to the gear mechanism. In the axial direction, i.e., perpendicularly to the plane of the figure, the distributor rollers 11 to 15 are driven formlockingly via worm gear mechanisms. The first distributor roller 11 and the fifth distributor roller 15 are preferably driven axially via one and the same worm gear mechanism, so that the distributor rollers 11 and 15 oscillate axially at the same frequency. Each of the remaining distributor rollers 12, 13 and 14, respectively, has a worm gear mechanism assigned thereto for the axial drive thereof, so that a total of four worm gear mechanisms are provided for the five distributor rollers 11 to 15 of the inking unit.

The rollers 7, 8, 9, 11, 12 and 13 form a first roller train that conveys the printing ink from the ink duct 4 to the printing form 3. A further roller train includes the rollers 7, 10, 12, 13 and 14 and other transfer rollers not specifically identified. The rollers, 7, 12, 13, 14 and 15 are likewise constituent parts of a third roller train, to which the applicator roller 10 does not belong, but another applicator roller bearing on the fifth distributor roller 15 does belong. From the foregoing explanations, it can be seen that specific rollers in the inking unit belong simultaneously to different roller trains. The second distributor roller 12 is a branching location at which the first roller train and the second roller train separate from one another. From the third distributor roller 13 to as far as the second distributor roller 12, the first roller train and the second roller train are identical.

The fifth distributor roller 15 oscillates in the axial direction with an amplitude which differs from the amplitude of the oscillations of the remaining distributor rollers 11 to 14. The amplitude of the fifth distributor roller 15 is smaller and at least approximately half as great as the uniform amplitude of the distributor rollers 11 to 14. In precise terms, the amplitude of the fifth distributor roller 15 is nine millimeters, and each of the distributor rollers 11 to 14 oscillates with an amplitude of up to 17.5 mm.

The step-down ratios of the worm gear mechanisms mentioned hereinbefore, via which the distributor rollers 11 to 15 are driven axially, are selected so that at least one of the distributor rollers 11, 14, 15, which bear on the applicator rollers 9 and 10 and are therefore close to the printing form 3, oscillates more slowly in the axial direction than at least one of the distributor rollers 12, 13 which do not bear on any applicator roller and are therefore closer to the ink duct 4, the distributor rollers 12 and 13 preferably oscillating at the same rate in relation to one another.

In the hereinafter following text, "Q" designates quotients which express the number of complete revolutions of the printing-form cylinder 2 for each complete oscillation period of the axial oscillation, respectively, of one of the distributor rollers 11 to 15. The quotients are whole, even numbers. The greater the quotient Q of a distributor roller, the lower the frequency of the axial oscillation of this distributor roller. The indices with which the quotients are provided indicate the distributor rollers to which the quotients relate. For example, $Q_{13}=2$ signifies that one complete oscillation of the third distributor roller 13 lasts for two complete revolutions of the printing-form cylinder 2. In other words, during one complete revolution of the printing-form cylinder 2, the third distributor roller 13 carries out precisely one-half of an oscillation, i.e., from a central position to as far as a dead point and back again to the central position.

With regard to the mutual coordination of the quotients, the following alternatives are particularly advantageous:

Alternative 1:

$$Q_{12}=Q_{13}=2$$

$$Q_{11}=Q_{14}=Q_{15}4$$

The first alternative is distinguished by the fact that all the distributor rollers 11, 14 and 15 which bear on the applicator rollers 9 and 10 oscillate axially at one and the same frequency, which is lower than the frequency at which the remaining distributor rollers 12 and 13 oscillate axially.

Alternative 2:

$$Q_{12}=Q_{13}=2$$

$$Q_{11}=Q_{15}=2$$

$$Q_{14}=4$$

The second alternative is distinguished by the fact that the distributor rollers which bear on the applicator rollers 9 and 10 oscillate axially at mutually different frequencies. In precise terms, the central, fourth distributor roller 14 oscillates more slowly than the two outer distributor rollers 11 and 15, the frequency of which corresponds to that of the distributor rollers 12 and 13.

Alternative 3:

$$Q_{12}=Q_{13}=2$$

$$Q_{11}=Q_{15}=4$$

$$Q_{14}=6$$

The third alternative is distinguished by the fact that the distributor rollers 11 to 15 simultaneously oscillate axially at least at three different oscillation frequencies. The distributor rollers 11, 14 and 15 oscillate simultaneously at two different frequencies, each of which is lower than the frequency of the axial oscillation of the distributor rollers 12 and 13 which are arranged upline of the distributor rollers 11, 14 and 15 in the ink transport path. Each of the distributor rollers 12 and 13 oscillates twice as rapidly as each of the two outer distributor rollers 11 and 15 and three times as rapidly as the central distributor roller 14.

Of course, in addition to the preferred alternatives 1 to 3 explained hereinabove, yet further alternatives are conceivable, but they are all distinguished by the fact that at least one of the distributor rollers 11, 14 and 15 which bear on the applicator rollers 9 and 10 oscillates more slowly than the third distributor roller 13, whereon the vibrator or ductor roller 6 bears periodically. For example, modifications relating to alternatives 1 to 3 are conceivable wherein the quotient of the first distributor roller 11 that leads in the direction of rotation of the printing-form cylinder 2, $Q_{11}=6$, and/or the quotient of the distributor roller 12 arranged between the distributor rollers 11 and 13 within the first roller train is $Q_{12}=4$.

By using the following explanation of the function of the inking unit, the advantages which are inherent in each of the alternatives 1 to 3 and the modifications thereof will be indicated.

The ink film on the ink duct roller 5 is not only profiled in accordance with the printing image on the printing form 3 but also has ink-free circumferential strips necessitated by the construction of the ink metering system. During the transfer of the ink film by the vibrator or ductor roller 6 from the ink duct roller 5 to the third distributor roller 13, the ink-free circumferential strips are also depicted on the latter. In order to ensure that the ink-free circumferential strips are not illustrated on the printing form 3 as faults, the ink film transferred from the vibrator or ductor roller 6 to the first roller train is powerfully distributed in the lateral direction already in the starting region of the first roller train and the ink transport path, by the comparatively rapidly oscillating distributing rollers 12 and 13. The frequency and the amplitude of the axial oscillation of the distributor rollers 12 and 13 is selected so that during this leveling of the ink-free circumferential strips, the zonal ink profile set by the ink metering system is maintained to an adequate extent.

In various studies, it has been shown that although a relatively good elimination of the ink-free circumferential strips can likewise be achieved, no adequate equalization of the ink gradient in the printing direction can be achieved if the distributor rollers 11, 14 and 15 oscillate just as quickly as the distributor rollers 12 and 13, i.e., if all five distributor rollers 11 to 15 oscillate equally quickly.

For this reason, in the inking unit according to the invention, at least one of the lower distributor rollers 11, 14 and 15 oscillates more rapidly than the distributor roller 13 disposed upline of this lower distributor roller in the ink transport path. Due to the graduation of the frequencies of the oscillations of the distributor rollers 11 to 15, selected in accordance with the invention, the two opposing requirements, the cancellation of the ink-free circumferential strips and the leveling of the ink gradient, can be met simultaneously in an optimum manner. This is achieved by the provision that oscillation frequencies along the roller train decrease from distributor roller to distributor roller towards the printing form 3. The high distributor roller oscillation frequency at the start of the roller train effects the early cancellation of the ink-free circumferential strip. The lower distributor roller oscillation frequency at the end of the roller train, i.e., close to the printing form 3, has the effect of reducing the so-called distribution angle. The smaller the distribution angle, the better the ink gradient is equalized. The amplitude of the axial oscillation of a distributor roller, divided by the developed length of the printing-form cylinder 2 during this oscillation, produces the sine of the distribution angle. In this regard, the developed length is the product of the circumferential length of the printing-form cylinder 2 and the number of revolutions executed by the printing-form cylinder 2 during the oscillations of the distributor roller.

We claim:

1. An inking unit for a printing machine, which is assigned to a printing form, comprising:

a first distributor roller and a second distributor roller, said first distributor roller being in rolling contact simultaneously with two ink applicator rollers and being disposed more closely to the printing form than said second distributor roller, said first distributor roller axially oscillating more slowly than said second distributor roller, said first and second distributor rollers being rotatively driven formlockingly.

2. The inking unit according to claim 1, wherein said second distributor roller is axially oscillatable twice as quickly as said first distributor roller, so that a ratio between frequencies of oscillations of said two distributor rollers is 1:2.

3. The inking unit according to claim 1, wherein a ratio between frequencies of the axial oscillations of said two distributor rollers is 1:3.

4. The inking unit according to claim 1, wherein said second distributor roller is disposed more closely to an ink duct than is said first distributor roller.

5. The inking unit according to claim 1, further comprising a gear mechanism for axially oscillating said first distributor roller more slowly than said second distributor roller.

6. A printing machine having a printing form and an inking unit, comprising:

a first distributor roller and a second distributor roller, said first distributor roller being in rolling contact simultaneously with two ink applicator rollers and being disposed more closely to the printing form than said second distributor roller, said first distributor roller axially oscillating more slowly than said second distributor roller, said first and second distributor rollers being positively driven in a rotational manner.

7. The inking unit according to claim 6, further comprising a gear mechanism for axially oscillating said first distributor roller more slowly than said second distributor roller.

* * * * *